United States Patent [19]

Weinert

[11] 4,330,064

[45] May 18, 1982

[54] BROKEN PACKAGE CULLING SYSTEM

[75] Inventor: Lawrence E. Weinert, Antioch, Calif.

[73] Assignee: Crown Zellerbach Corporation, San Francisco, Calif.

[21] Appl. No.: 193,051

[22] Filed: Oct. 2, 1980

[51] Int. Cl.[3] ..... B07C 5/36

[52] U.S. Cl. ..... 209/617; 209/707; 209/699

[58] Field of Search ..... 209/617, 618, 707, 699

[56] References Cited

U.S. PATENT DOCUMENTS

| | | | |
|---|---|---|---|
| 1,485,896 | 3/1924 | Thompson | 209/617 X |
| 2,895,611 | 7/1959 | Barkway | 209/618 |
| 3,540,584 | 11/1970 | Laukaitis | 209/617 X |
| 4,148,213 | 4/1979 | Prakken | 209/699 X |
| 4,265,361 | 5/1981 | Schroeder | 209/617 |

*Primary Examiner*—Allen N. Knowles

*Attorney, Agent, or Firm*—Thomas R. Lampe

[57] ABSTRACT

A system for culling broken packages wherein the packages are transported while maintained between support means and restraining means in the form of narrow conveyor belts in such a manner that broken packages will tip under the influence of gravity and be displaced from the support means while unbroken packages are prevented from doing so.

8 Claims, 6 Drawing Figures

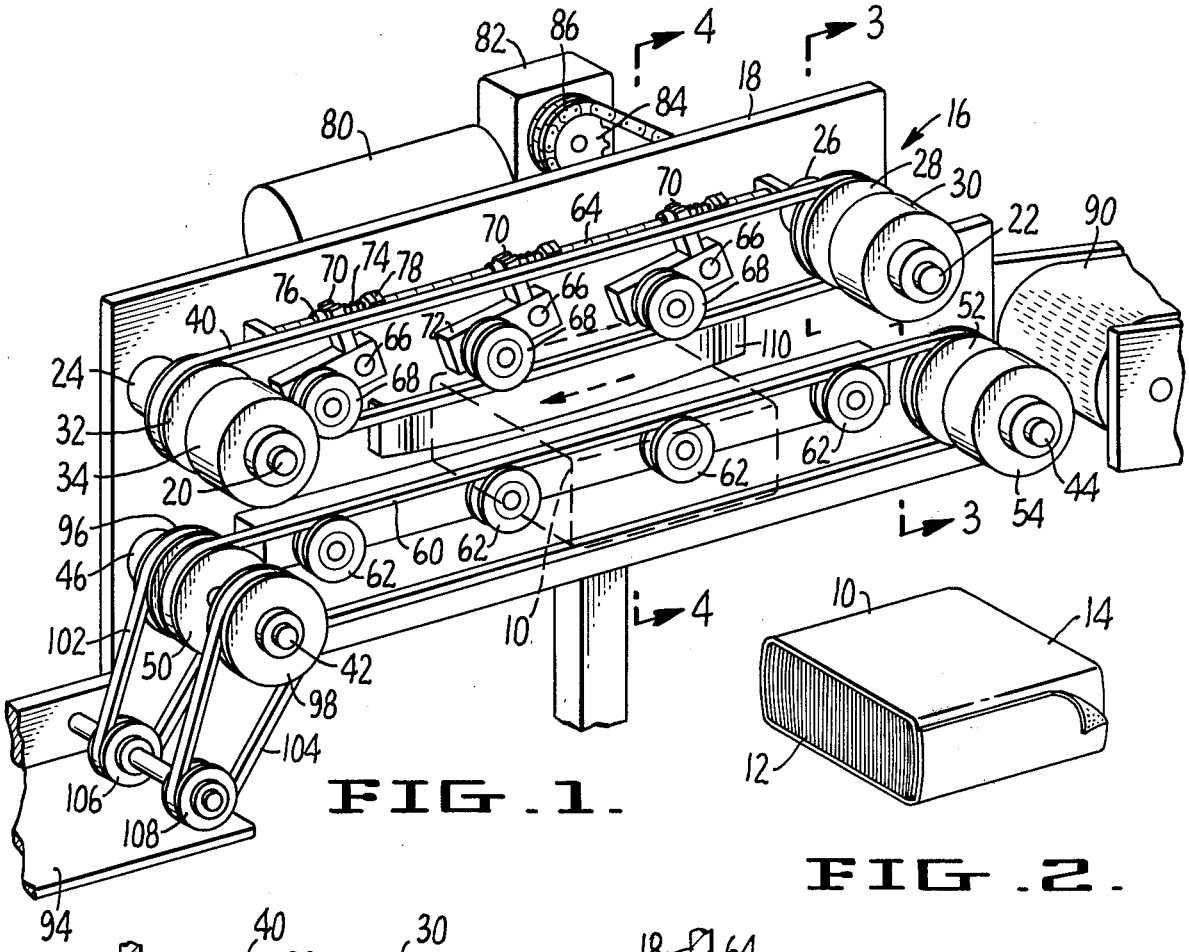
FIG. 1.
FIG. 2.
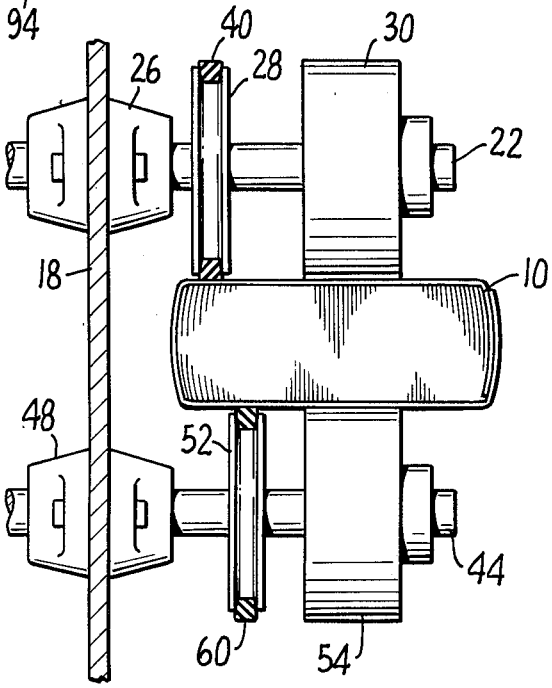
FIG. 3.
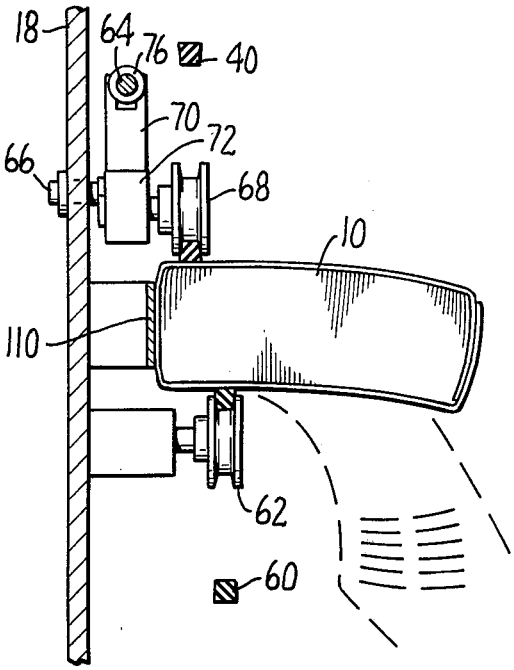
FIG. 4.

BROKEN PACKAGE CULLING SYSTEM

BACKGROUND AND OBJECTS OF THE INVENTION

This invention relates to a system for culling or discarding broken packages and has particular application to the processing of banded stacks of towels or the like.

A variety of systems for culling broken or otherwise defective packages are in existence. Such prior art devices are characterized by their relatively high degree of complexity and cost.

It is therefore an object of the present invention to provide a culling system which is characterized by its simplicity of construction and low capital and operating costs. The system employs no elaborate or complex mechanisms or elaborate sensing arrangements of the types often found in prior art culling systems.

SUMMARY OF THE INVENTION

According to the present invention, apparatus is provided for receiving packages such as banded stacks of paper toweling or the like and conveying said packages to a predetermined location. During conveying, the packages are supported on support means in the form of a relatively narrow conveyor belt at a predetermined offset location with respect to the package bottoms whereby the packages will tend to tip and be displaced from said support means under the influence of gravity. A restraining means in the form of a second conveyor belt engages the packages in such a fashion as to prevent the packages from tipping and being displaced from the bottom conveyor belt when the packages aren't broken and allow the packages to tip and be displaced from the lower conveyor belt when the packages are broken.

Other objects and characteristics of the invention will be apparent from the following more detailed description and accompanying drawings in which:

DESCRIPTION OF DRAWINGS

FIG. 1 is a perspective view of apparatus constructed in accordance with the teachings of the present invention;

FIG. 2 is a perspective view of a banded package of paper toweling or the like;

FIG. 3 is a sectional view taken along line 3—3 in FIG. 1;

FIG. 4 is a sectional view taken along line 4—4 in FIG. 1;

DETAILED DESCRIPTION

The apparatus of the present invention is adapted to cull or discard packages 10 of the type illustrated in FIG. 2 which comprises a stack of paper towels or the like 12 held together by a band 14 of paper or other suitable material which extends around four sides of the stack and is secured at its overlapping ends as by means of adhesive, tape etc. In the package of FIG. 2 one corner of the overlapping band end is shown in the position assumed thereby just prior to being placed into engagement with the other end of the band.

It will be appreciated that equipment failures, improper adhesive application, etc. in the packaging line will occasionally result in a broken package, e.g. a package wherein the towel stack is not securely retained by the band 14. It is for the purpose of culling out or displacing such broken packages that the system of the present invention has been devised.

Figure 6:
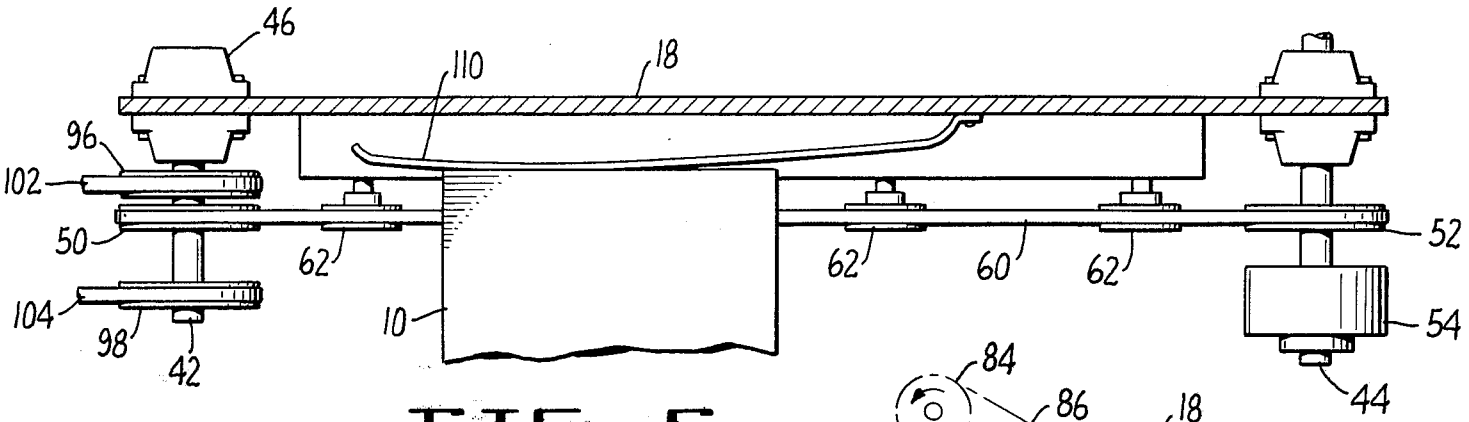
FIG. 6 is a sectional view taken along line 6—6 of FIG. 5.
Figure 5:
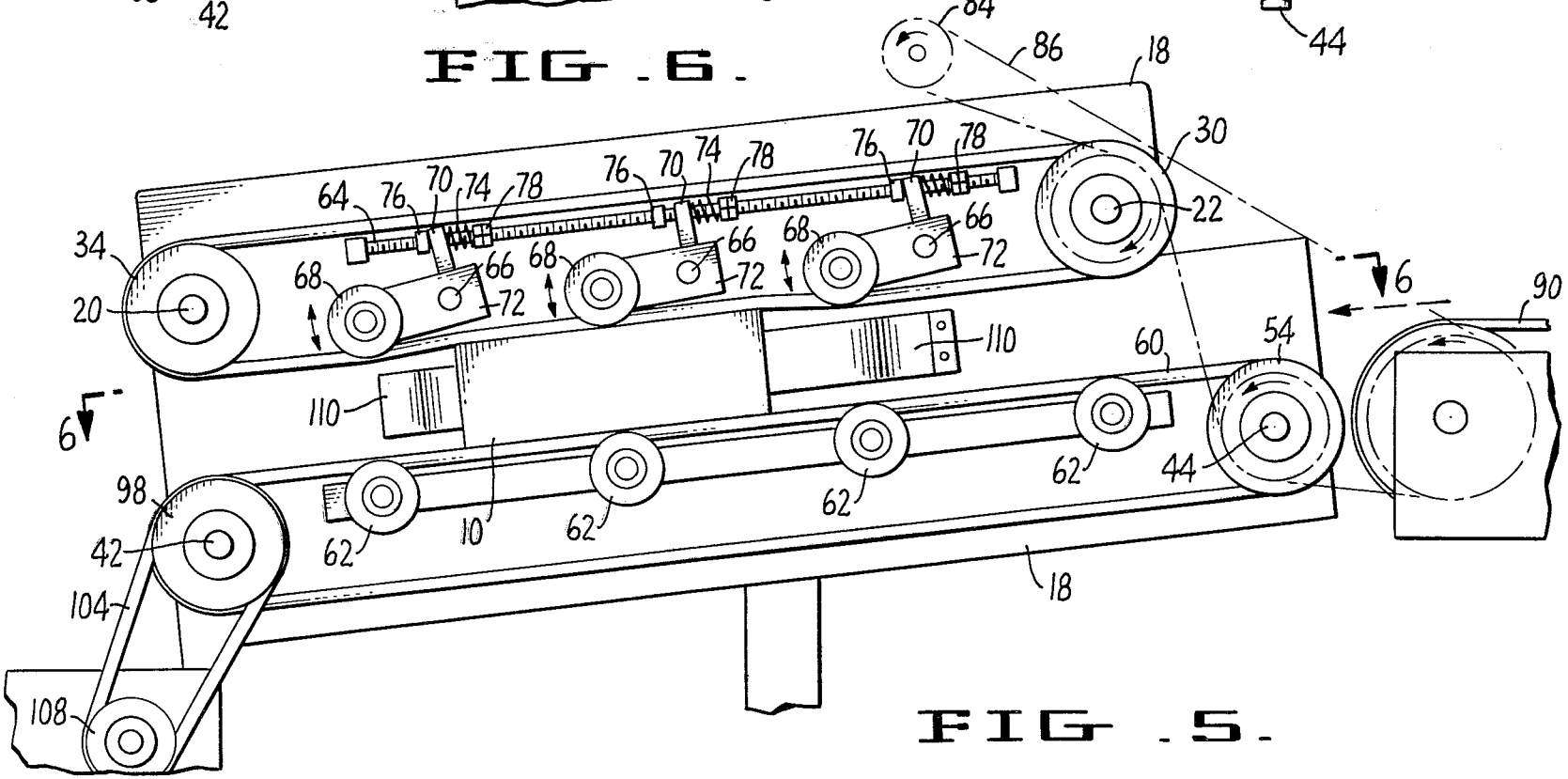
FIG. 5 is a side elevational view of the apparatus shown in FIG. 1.

Referring now to FIGS. 1 and 3–6, apparatus constructed in accordance with the teachings of the present invention is generally designated by means of reference numeral 16. Apparatus 16 includes a support plate 18 through which project rotatable shafts 20 and 22 journaled in housings 24, 26, respectively, secured to the support plate. A pulley 28 is fixedly mounted on shaft 22 as is cylinder 30. Likewise, rotatable shaft 20 has pulley 32 and cylinder 24 attached thereto. A narrow conveyor belt 40 is wrapped around pulleys 28, 32 in the manner illustrated.

A second set of rotatable shafts 42, 44 are mounted in housings 46, 48 respectively, attached to support plate 18. A pulley 50 is fixedly mounted on shaft 42 and a pulley 52 of like construction is attached to shaft 44. A cylinder 54 is also attached to shaft 44. A conveyor belt 60 is disposed about pulleys 50, 52. As may perhaps best be seen with reference to FIG. 3, conveyor belt 60 is not disposed directly under conveyor belt 40, but rather is laterally displaced therefrom to some degree. Auxilliary rollers 62 are disposed under the upper run of conveyor belt 60 to maintain the run in a substantially straight configuration. Alternatively a fixed member or members could be used in place of rollers 62 to provide support surface for the belt 60 upper run to slide upon.

Rollers 68 mounted above the lower run of conveyor belt 40 apply a downward force on a package 10 passing thereunder as described below. The rollers 68 are mounted on the arms 72 of bellcranks which pivot about support posts 66 which are mounted on support plate 18. The lower position of rollers 68 (with no package present) is controlled by the bellcrank's upper arm 70 contacting the adjustable stops 76 on the threaded rod 64 which is mounted on support plate 18. The downward force of the rollers is derived from gravity and from springs 74 acting on the bellcrank arms 70. This force is adjustable by the double nuts 78 which are also mounted on rod 64.

Disposed behind support plate 18 is an electric motor 80 operatively connected to a gear box 82. A drive shaft projects from gear box 82 and has a drive sprocket 84 fixedly attached thereto. Looped about drive sprocket 84 is a drive chain 86 which is connected to sprockets fixedly attached to the ends of shafts 22 and 44 which project from the back of support plate 18. Thus, rotation of drive gear 84 will cause rotation of conveyor belts 40 and 60. It will be appreciated that the drive mechanism employed will serve to rotate conveyor belt 40 in a clockwise direction and conveyor 60 in a counter-clockwise direction, as viewed in FIG. 1 and FIG. 5. Drive chain 86 is also operatively associated with a feed conveyor 90 which serves to deliver packages in a serial fashion from conventional packaging machinery (not shown).

As each package 10 is delivered by feed conveyor 90 the bottom thereof is supported at an offset location by conveyor belt 60 in the manner perhaps best illustrated in FIG. 3. After passing cylinder 54 the package 10 will have a tendency to tip and be displaced from the conveyor belt 60 under the influence of gravity. Insofar as integral unbroken packages 10 are concerned, this tipping action is prevented by the fact that conveyor belt 40 engages package 10 closer to the end thereof than does conveyor belt 60. If, on the other hand, package 10 is broken due to failure of band 14 or for any other reason such as adhesive failure, the package will tend to fall apart and be displaced from conveyor belt 60 as illustrated in FIG. 4. It will be appreciated that conveyor belts 40 and 60 continually transport package 10 during this culling operation. Thus, integral or unbroken packages will be delivered toward the left ends of the conveyor belts as viewed in FIG. 1 whereat the unbroken packages will be delivered in a serial fashion to a conveyor or chute 94. Belts 40 and 60 are preferably driven slightly faster than conveyor 90 to assure separation between packages 10. The packages 10 are stabilized at this discharge end by auxilliary pulleys 96 and 98 mounted on shaft 42 along with pulley 50. Belts 102 and 104 extend from the auxilliary pulleys to idler pulleys 106 and 108 which assist in delivery of packages 10 on end to member 94.

The culling apparatus of this invention preferably incorporates means for assisting in the displacement of broken packages from conveyor belts 40 and 60. In particular, a resilient pressure plate 110 is attached at one end thereof to support plate 18. The pressure plate 110 will not exert sufficient pressure to dislodge an unbroken package 10 from conveyor belts 40 and 60. It will, however, exert enough pressure to assist in the complete dislodging of a broken package 10 from between the conveyor belts.

I claim:

1. Apparatus for culling broken packages comprising:

support means for supporting the bottoms of said packages at a predetermined offset location with respect to said package bottoms whereby said packages will tend to tip and be displaced from said support means under the influence of gravity;

restraining means for engaging said packages to prevent said packages from tipping and being displaced from said support means when said packages are unbroken and allow said packages to tip and be displaced from said support means when the packages are broken; and means for moving said support means to transport said packages along a predetermined path of movement.

2. The apparatus of claim 1 wherein said support means comprises a conveyor belt.

3. The apparatus of claim 2 wherein said restraining means comprises a second conveyor belt.

4. The apparatus of claim 1 additionally comprising package displacement means disposed along the path of movement of said packages for engaging said packages and assisting in the displacement of broken packages from said support means.

5. The apparatus of claim 4 wherein said package displacement means comprises means for exerting a pressure on said packages.

6. Apparatus for culling broken packages comprising:

first means for engaging a first surface of said packages;

second means for engaging a second surface of said packages, said first and second means cooperating with each other and with packages positioned therebetween to prevent unbroken packages from being displaced therefrom under the influence of gravity and to permit broken packages to be displaced therefrom under the influence of gravity.

7. A method for culling broken packages comprising:

supporting the bottoms of said packages at an offset location whereby said packages will tend under the influence of gravity to tip and fall;

engaging the tops of said packages at a predetermined location thereon to prevent said packages from tipping and falling when said packages are unbroken and to permit broken packages to tip and fall; and transporting said packages along a predetermined path of movement substantially simultaneously with said supporting and engaging steps.

8. The method of claim 7 further comprising the step of applying a force to at least one side of said packages during transport thereof.

* * * * *